US008839770B1

(12) United States Patent
Crouse

(10) Patent No.: US 8,839,770 B1
(45) Date of Patent: Sep. 23, 2014

(54) BOW CRUTCH

(71) Applicant: Gary Crouse, Freeport, ME (US)

(72) Inventor: Gary Crouse, Freeport, ME (US)

( * ) Notice: Subject to any disclaimer, the term of this patent is extended or adjusted under 35 U.S.C. 154(b) by 65 days.

(21) Appl. No.: 13/688,567

(22) Filed: Nov. 29, 2012

Related U.S. Application Data

(60) Provisional application No. 61/565,003, filed on Nov. 30, 2011.

(51) Int. Cl.
*F41B 5/18* (2006.01)
*F41B 5/14* (2006.01)

(52) U.S. Cl.
CPC ..... *F41B 5/1469* (2013.01)
USPC ..... 124/35.2; 124/1; 124/86; 124/88; 124/90

(58) Field of Classification Search
CPC ..... F41B 5/1469; F41B 5/14
USPC ..... 124/1, 35.2, 86, 88, 90
See application file for complete search history.

(56) References Cited

U.S. PATENT DOCUMENTS

| | | | | | |
|---|---|---|---|---|---|
| 1,210,332 | A | * | 12/1916 | Kvistad | 124/23.1 |
| 2,664,078 | A | * | 12/1953 | Irwin | 124/24.1 |
| 2,926,650 | A | * | 3/1960 | Irwin | 124/24.1 |
| 2,982,279 | A | * | 5/1961 | Pursley | 124/35.1 |
| 3,512,512 | A | * | 5/1970 | Wentz | 124/24.1 |
| 3,561,418 | A | * | 2/1971 | Fredrickson | 124/24.1 |
| 3,794,012 | A | * | 2/1974 | Ramsey | 124/24.1 |
| 3,895,621 | A | * | 7/1975 | Kellogg | 124/24.1 |
| 4,041,925 | A | * | 8/1977 | Barrick | 124/35.2 |
| 4,061,125 | A | * | 12/1977 | Trotter | 124/23.1 |
| 4,066,051 | A | * | 1/1978 | Alban | 124/86 |
| 4,146,009 | A | * | 3/1979 | Adams | 124/88 |
| 4,603,676 | A | * | 8/1986 | Luoma | 124/25 |
| 4,615,326 | A | * | 10/1986 | Rathbun | 124/88 |
| 4,732,133 | A | * | 3/1988 | Chattin | 124/24.1 |
| 4,919,107 | A | * | 4/1990 | Bunts | 124/24.1 |
| 5,000,154 | A | * | 3/1991 | Slayton | 124/23.1 |
| 5,065,730 | A | * | 11/1991 | Kluver | 124/35.2 |
| 5,146,908 | A | * | 9/1992 | Larson | 124/88 |
| 5,205,268 | A | * | 4/1993 | Savage | 124/24.1 |
| 5,243,957 | A | * | 9/1993 | Neilson | 124/88 |
| 5,320,085 | A | * | 6/1994 | Hanneman | 124/89 |
| 5,425,351 | A | * | 6/1995 | Kozitka | 124/88 |
| 5,465,705 | A | * | 11/1995 | Baeseman | 124/88 |
| 5,598,830 | A | * | 2/1997 | Creel, Sr. | 124/86 |
| 5,649,524 | A | * | 7/1997 | Pullin | 124/86 |
| 5,671,723 | A | * | 9/1997 | Goff et al. | 124/35.2 |
| 5,967,131 | A | * | 10/1999 | Hervig | 124/25.6 |
| 6,012,440 | A | * | 1/2000 | Grindle | 124/86 |
| 6,032,660 | A | * | 3/2000 | Hervig | 124/25.6 |
| 6,161,532 | A | * | 12/2000 | Goff et al. | 124/35.2 |
| 6,213,113 | B1 | * | 4/2001 | Groover et al. | 124/86 |
| 6,513,511 | B1 | * | 2/2003 | Garthe et al. | 124/25.6 |
| 6,968,836 | B1 | * | 11/2005 | Kees | 124/35.2 |
| 7,607,423 | B1 | * | 10/2009 | Kees et al. | 124/35.2 |
| 8,439,026 | B1 | * | 5/2013 | Kilian | 124/35.2 |

* cited by examiner

*Primary Examiner* — Gene Kim
*Assistant Examiner* — Alexander Niconovich
(74) *Attorney, Agent, or Firm* — Patricia M. Mathers

(57) ABSTRACT

An assist for drawing a bowstring of a compound bow to a position close to the standard draw position is described. The assist is a crutch that is inserted into a crutch mount that is affixed to the riser of the bow. The crutch allows the archer to place the bow on a support surface and to pull the bowstring up onto the crutch. When the archer is ready to shoot an arrow, he pulls the bowstring back from the crutch. The head of the crutch rotates into a vertical position, providing an unencumbered path for the arrow.

5 Claims, 4 Drawing Sheets

BOW CRUTCH

BACKGROUND INFORMATION

1. Field of the Invention

The invention relates to archery bows. More specifically, the invention relates to an accessory to facilitate drawing the bowstring to the standard draw position.

2. Discussion of the Prior Art

In a compound bow, the amount of force required to pull the bowstring to its standard draw is high during the first part of the draw and is reduced after a certain point. This reduction in force is referred to as a "let off". Despite the let off, a person must exert a significant amount of force to pull the bowstring to its draw point. This makes it difficult or impossible for persons who do not have the sufficient strength to complete the draw to engage in archery activities. This is particularly the case with older bows, which do not as much of a "let off."

What is needed is an assist for pulling the bowstring on a compound bow to the desired draw.

BRIEF SUMMARY OF THE INVENTION

The invention is a crutch that assists a user in pulling a bowstring on a compound bow to its standard draw without having to hold the bow in the operative position, i.e., holding the bow with outstretched arms in a vertical orientation.

A mount for the crutch is affixed to the riser of the bow and the distal end of the crutch is inserted into or onto the mount. The body of the crutch extends in the direction of the archer, bringing the proximal end of the crutch to a position that corresponds to the position of the bowstring at the standard draw position. The horizontal position of the crutch is just above or beneath the level of the arrow shelf.

To use the crutch, the archer places the bow on some firm surface, i.e., the ground, a low stool, on top of one foot, or some other support surface, inserts the distal end of the crutch into the crutch mount, and uses a foot to hold the bow against the support surface while simultaneously drawing the bowstring with one or two hands onto the proximal end of the crutch. The bowstring now remains in the draw position on the crutch, without the user having to hold the bowstring. The user can now bring the bow to the operative position and place the arrow at the nocking point on the string, all without having to exert the energy to hold the bowstring in place. Once the user is ready to shoot the arrow, he or she pulls the bowstring away from the crutch. The crutch now automatically rotates to a position that does not impede the release of the arrow.

The use of the crutch also allows a third person to assist an archer by pulling the bowstring onto the crutch for the archer.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. The drawings are not to scale, but are sufficient to illustrate the various elements of the inventive subject matter. The invention should not, however, be construed as limited to the embodiment set forth herein; rather, the embodiment is provided so that this disclosure will be complete and will fully convey the scope of the invention to those skilled in the art.

Note: references to place locations of elements are in reference to the archer holding a bow. Thus, "proximal" is closer to the archer than "distal", "front" is a face or surface that faces the archer, etc.

Figure 1:
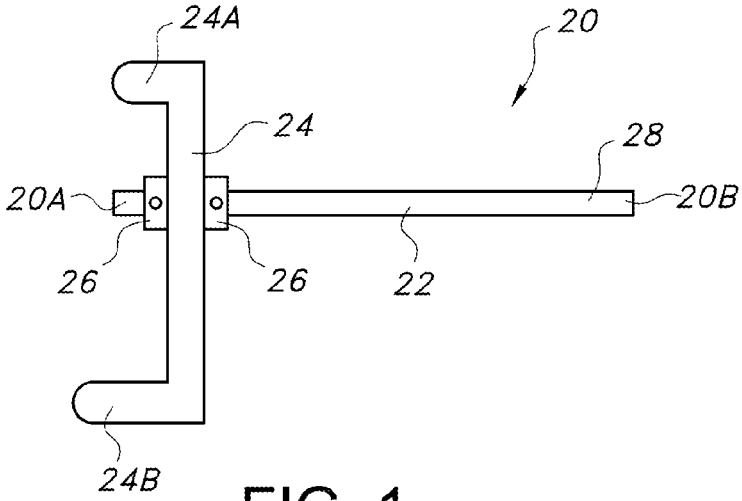
FIG. 1 is a side elevation view of the crutch according to the invention.
Figure 2:
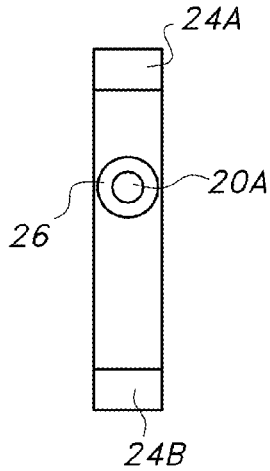
FIG. 2 is a front elevation view of the crutch in a relaxed state.

FIGS. 1 and 2 illustrate a crutch device 10 according to the invention, for use with a compound bow 100. The crutch device 10 comprises a crutch 20 and a crutch mount 30. The crutch 20 includes a crutch body 22 that has a crutch head 24 at a proximal end 20A and an insertion end 28 at a distal end 20B. The crutch head 24 is rotatably mounted on the crutch body 22 by some suitable means 26 that fixes the crutch head 24 a specific distance from the insertion end 28, yet allows the head to rotate about the body axis. In the embodiment shown, the means 26 is a pair of bushings 26A, each secured in place on the crutch body 22 with a set screw 26B. It is understood that other suitable means for rotatably securing the crutch head 24 to the crutch body 22 may be used.

The crutch head 24 is constructed asymmetrically, as shown in FIG. 1. A first end 24A is shorter, and thus, lighter in weight, than a second end 24B. The imbalance in weight ensures that the crutch head 24 will immediately rotate to a relaxed, i.e., vertical position, as shown in FIG. 1, unless some force is applied to it to hold it in a horizontal position.

Figure 3:
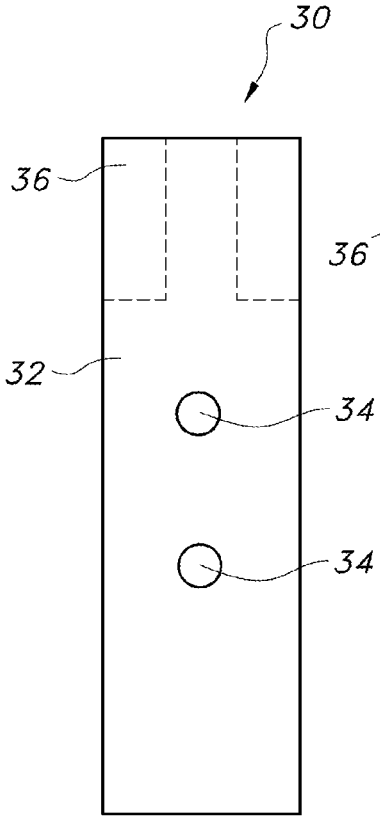
FIG. 3 is an outer side elevation view of the crutch mount.
Figure 4:
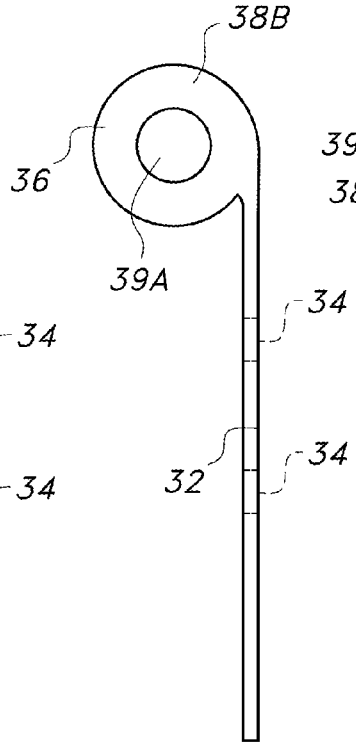
FIG. 4 is a rear elevation view of the crutch mount.
Figure 5:
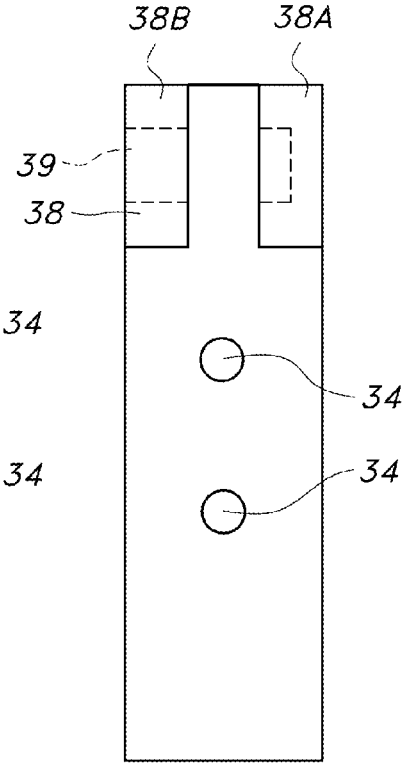
FIG. 5 is an inner side elevation of the crutch mount.

FIGS. 3-5 illustrate a crutch mount 30 that is mounted on a riser 110 of the bow 100 and receives the insertion end 28 of the crutch 20. The crutch mount 30 has a mounting plate 32 with mounting holes 34 and a receiving head 36. The mounting holes in the plate 32 are dimensioned so as to align with mounting holes that are provided in the conventional compound bow 100 for mounting the quiver or the string guide, thereby eliminating the need to bore additional holes into the bow. In the embodiment shown, the receiving head 36 has two sleeves 38, a proximal sleeve 38A and a distal sleeve 38B. The proximal sleeve 38A has a through-bore 39 that is dimensioned to allow the insertion end 28 of the crutch body 20 to pass through it and be supported by it. The distal sleeve 38B has a slight recess for retaining and supporting the insertion end 28 of the crutch body.

Figure 6:
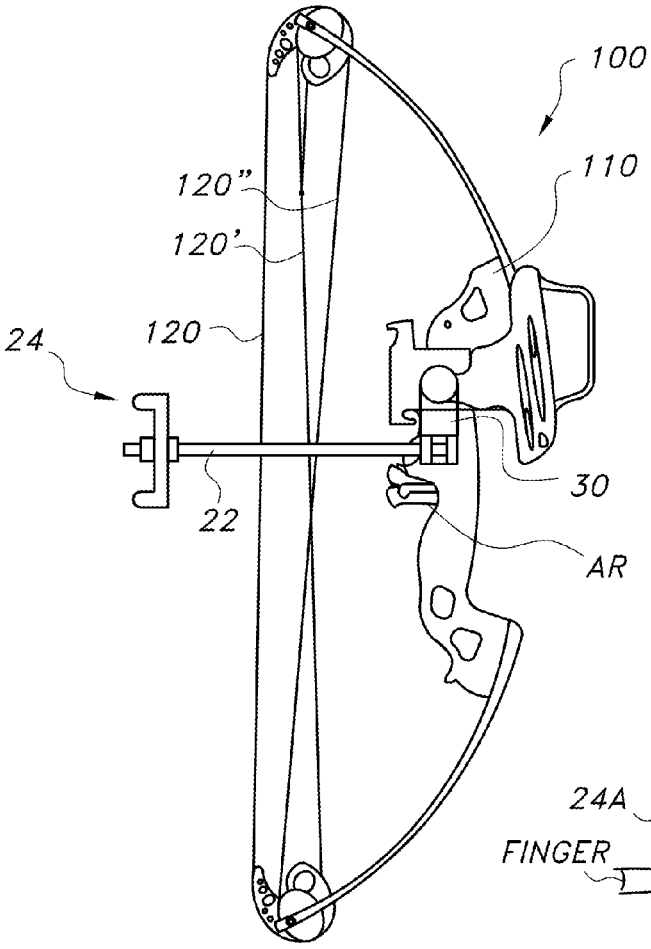
FIG. 6 shows the crutch assembled on the riser of a compound bow.
Figure 7:
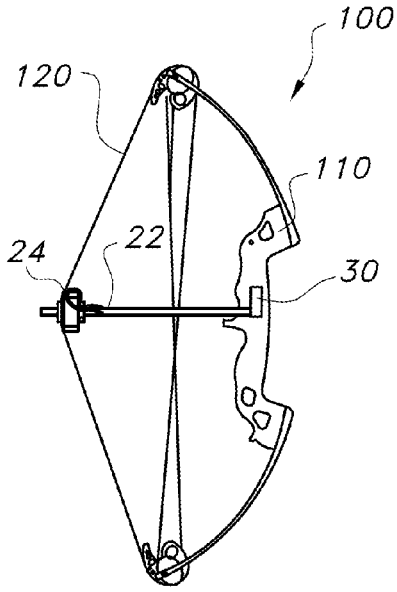
FIG. 7 illustrates the crutch inserted into the mount, with the bowstring pulled over the crutch head.
Figure 8:
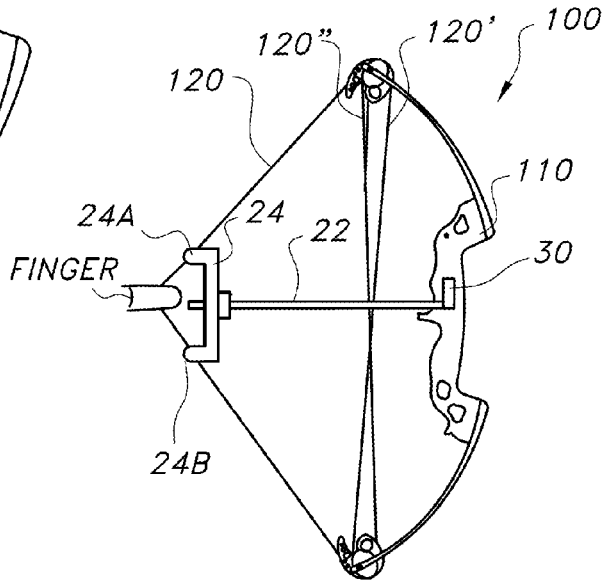
FIG. 8 shows the position of the crutch head when the bowstring has been pulled away from it.

FIG. 6 is a partial sketch of a conventional compound bow, illustrating the crutch mount 30 affixed to the riser 110 of the bow. Only the upper limb and riser are illustrated in this sketch. The crutch body 22 is shown inserted into the mount 30, just above the arrow rest AR. The compound bow 100 has a bowstring 120 that is stretched around, two pulleys, one at each end of a limb. The central stretch of the bowstring that is pulled by the archer is designated as 120; the two end stretches that are attached to the pulleys are designated 120' and 120". FIGS. 7 and 8 are very rudimentary sketches that show the crutch mount 30 mounted on the riser, with all other components that are typically mounted on the riser removed, for purposes of illustration. FIG. 7 illustrates the horizontal orientation of the crutch head 24 when the bowstring 120 is tensioned over the crutch head. FIG. 8 illustrates the vertical orientation of the crutch head 24, when the string is pulled away from the head and force of gravity has pulled the heavier side of the crutch head 24B downward, bringing the crutch head 20 to a vertical position.

Figure 9:
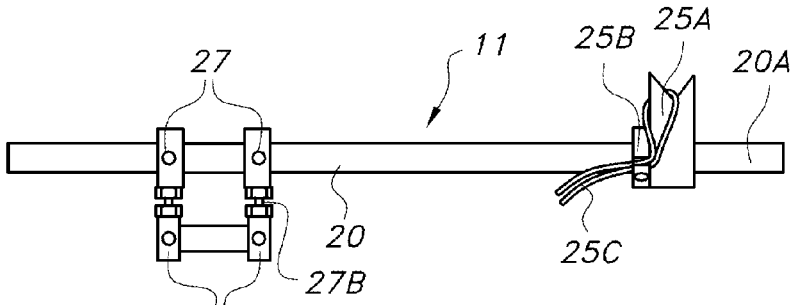
FIG. 9 illustrates a second embodiment of the crutch device according to the invention.
Figure 10:
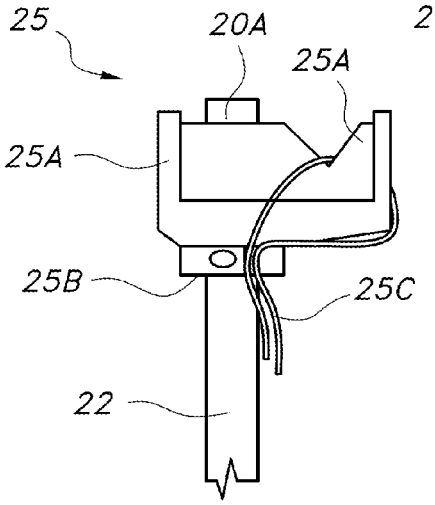
FIG. 10 is a perspective view of the crutch head.
Figure 11:
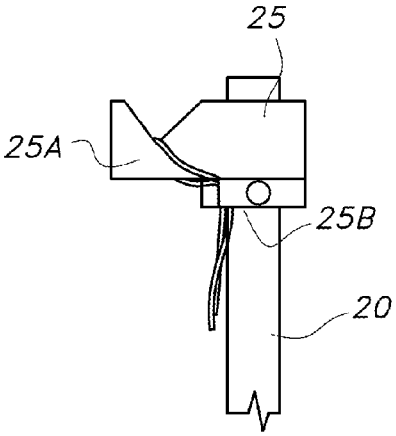
FIG. 11 is a side plan view of the crutch head, showing the bowstring holder.
Figure 12:
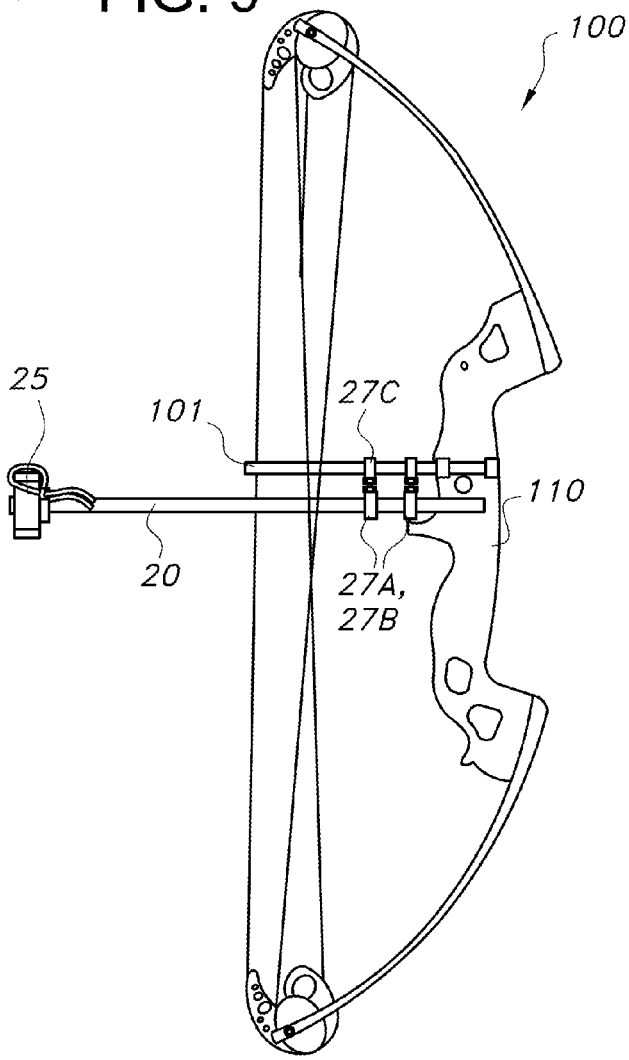
FIG. 12 illustrates a compound bow with a string guide, with the crutch device of FIG. 9 mounted on the string guide.

FIGS. 9-11 illustrate a second embodiment of the crutch device 11 according to the invention and FIG. 12 illustrates a compound bow 100 with rod 101 for a string guide, with the crutch device 11 mounted on the string guide 101. Compound bows can be very complex instruments, with many accessories mounted on them. FIG. 10 is a very simplified illustration of the compound bow, and the bow itself is shown for the purposes only of illustrating the cable or string guide 101 that is mounted on the riser 110. This crutch device 11 is a simplified version that is mounted directly on the string guide 101 and comprises the crutch 20 with the proximal end 20A and the distal end 20B, and a spring-biased crutch head 25 mounted toward the proximal end. A mounting means 27 is provided for mounting the device 11 on the string guide. In this embodiment, the mounting means 27 includes one or more collars 27A that are adjustably mounted on the crutch body 22. Attached to the collar 27A is a threaded rod 27B with a bushing 27C. The bushing 27C has a set screw for tightening it to a desired position on the string guide rod 101. FIG. 10 shows the crutch device 11 mounted on the string guide rod 101.

The spring-biased crutch head 25 has bowstring holders 25A for holding the bowstring in a loaded position. A collar 258 is mounted on the proximal end of the crutch body 22 and fixed in place. A position-biasing means 25C is captured by the collar 25B and coupled with the crutch head 25, so as to bias the crutch head to a home position. The crutch head 25 in this embodiment is slidably mounted on the crutch body 22 and is held there by the biasing means 25C.

Figure 13:
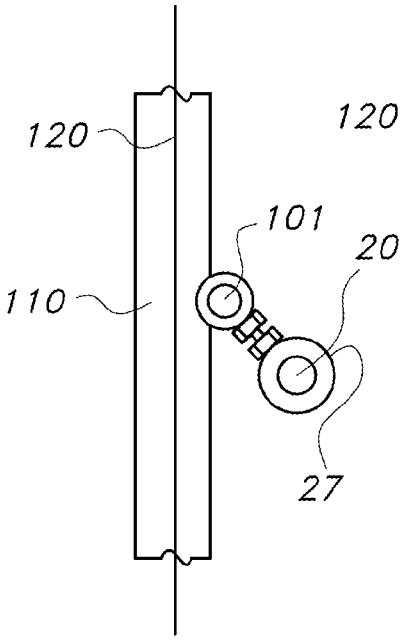
FIG. 13 is a schematic illustration, front view, of the riser portion of a compound bow, illustrating the crutch device mounted on the string guide.
Figure 14:
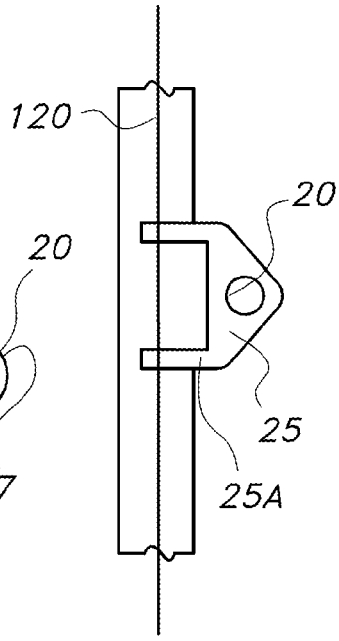
FIG. 14 is the same view as FIG. 13, with the bowstring pulled onto the crutch head, showing the crutch head in its tensioned position.
Figure 15:
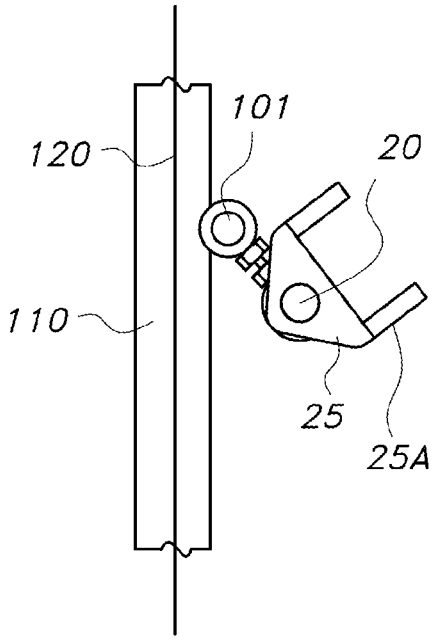
FIG. 15 is the same view as FIG. 13, but without the bowstring pulled onto the crutch device, showing the crutch device in its home position.

FIGS. 13-15 are schematic illustrations of the position of the crutch device 11 on the compound bow. FIG. 13 shows the crutch body 20 mounted to the string guide 101. For purposes of illustration, the crutch head 25 is not shown. FIG. 14 illustrates the position of the crutch head 25 when tensioned by the bowstring 120 and FIG. 15 the home position of the crutch head 25. As shown, the untensioned crutch head 25 is rotated to its home position, with the bowstring holders 25A facing away from the bowstring. The tension device 25C ensures that the crutch head 25, when the bowstring is released from the crutch head, immediately moves out of the way of the arrow.

Use of the Crutch:

If the crutch device is the first embodiment, then the crutch mount 30 has previously been affixed to the riser 110 of the bow and the archer inserts the crutch body 22 into the crutch mount 30. If the device is the second embodiment, the crutch body has previously been mounted to the string guide. The archer places the compound bow on some support surface, with the front face of the bow facing upward. Placing a foot over the bow, to hold it against the support surface, the archer then pulls the bowstring 120 with one or two hands upward and onto the crutch head 24 or 25. The archer can now pick up the bow and resume the normal archer's stance, ready to shoot. When the bowstring is pulled away from the crutch head 24, the head immediately rotates into the home position, allowing the archer to shoot the arrow without the crutch head obstructing the path of the arrow.

Figure 16:
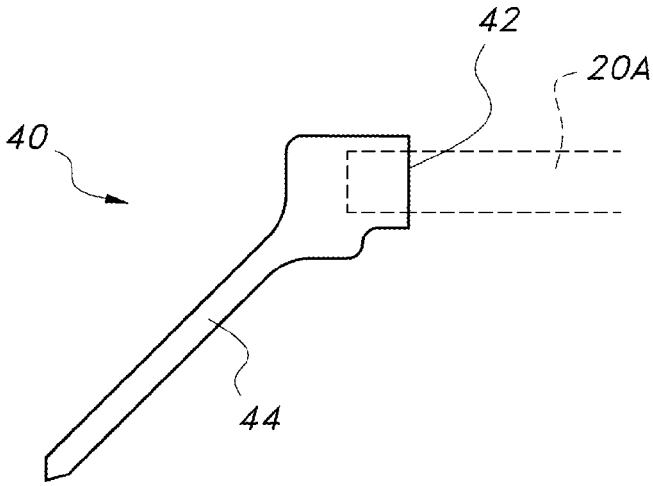
FIG. 16 illustrates a bowstring safety device that may be used with any embodiment of the crutch device according to the invention.

A bowstring safety device 40 may be used with the crutch device 10 or 11. The safety device 40 has a bore 42 that is dimensioned to fit over the proximal end 20A of the crutch body 22 and a plastic deflector or shield 44, such as is shown in FIG. 16, that prevents the bowstring from moving to the outside of the crutch head.

As with any device or tool that is tensioned or loaded for use, it is advisable to release the tension when the device is not in use. This is the case with the bow also, The crutch should not remain loaded for an extended period of time, because the load will eventually weaken the limbs.

It is understood that the embodiments described herein are merely illustrative of the present invention. Variations in the construction of the crutch may be contemplated by one skilled in the art without limiting the intended scope of the invention herein disclosed and as defined by the following claims.

What is claimed is:

1. A crutch device for use with a compound bow having a bow string, the crutch comprising:

a crutch body with mounting means for mounting the crutch body to the compound bow;

a crutch head rotatably mounted on the crutch body for receiving and holding the bowstring in a ready-to-shoot position, the crutch head being a unitary asymmetrically C-shaped piece having a first end that is shorter than a second end and a middle section therebetween, so as to bias by weight the crutch head to a home position; and a crutch-head mount for mounting the crutch head to the crutch body;

wherein, when a user loads the crutch head, the crutch head is rotated to a loaded position in which the middle section is in a horizontal orientation and transverse to an orientation of the bowstring and, when the user releases the bowstring from the crutch head, the crutch head automatically and immediately returns to the home position, in which the middle section is in a vertical orientation.

2. The crutch device of claim 1, wherein the compound bow has a string guide and the crutch body is mounted on the string guide.

3. The crutch device of claim 1, further comprising a mechanical biasing device that includes a mounting collar and a spring-biasing means captured in the collar, and wherein the spring-biasing means is removably couplable to the crutch head to bias the crutch head toward the home position.

4. The crutch device of claim 3, wherein the spring-biasing means is an elastic device.

5. The crutch device of claim 1, wherein the mounting means for the crutch body includes a bracket that is mountable on the compound bow, the bracket having a recess for receiving an end of the crutch body.

* * * * *